US005226282A

United States Patent [19]

Meyers

[11] Patent Number: 5,226,282

[45] Date of Patent: Jul. 13, 1993

[54] SADDLERY DEVICE

[76] Inventor: Vilma Meyers, P.O. Box 2664, Rancho Santa Fe, Calif. 92067

[21] Appl. No.: 808,419

[22] Filed: Dec. 16, 1991

[51] Int. Cl.[5] ..... B68C 1/14

[52] U.S. Cl. ..... 54/23; 54/46.1

[58] Field of Search ..... 54/23, 35, 46; 24/32, 24/68 E, 165

[56] References Cited

U.S. PATENT DOCUMENTS

| | | | |
|---|---|---|---|
| 500,619 | 7/1893 | Russell | 54/23 |
| 878,058 | 2/1908 | Groff | 54/23 X |
| 1,718,291 | 6/1929 | Guenther | 24/199 |
| 4,414,790 | 11/1983 | Mitchell | 54/23 X |
| 4,470,174 | 9/1984 | Rhea | 24/68 E |

*Primary Examiner*—Robert P. Swiatek

*Attorney, Agent, or Firm*—Harness, Dickey & Pierce

[57] ABSTRACT

This is a device to assist a person to quickly and easily fasten and tighten the girth strap of a saddle. When a horse is being saddled, some horses have a tendency to inflate their girth making it difficult to attach the girth buckle to the billet strap. The present device hooks into an upper hole on the billet strap and then loops through the girth buckle so that a person can apply a leveraged upper force to the girth buckle making it easier to securely fasten the girth buckle to the billet strap and thereby securely fasten a saddle to a horse.

4 Claims, 1 Drawing Sheet

SADDLERY DEVICE

BACKGROUND OF THE INVENTION

When fastening an English saddle to a horse it is necessary to attach the girth strap and buckle from one side of the saddle underneath the horse to the other side of the saddle where there is located a billet strap. Frequently a horse, sensing that a saddle will be fastened, inflates his girth making it difficult for children and adults who do not have sufficient strength to efficiently tighten the girth of their saddle. Therefore, it would be useful to have a device which a person could use to apply leverage to the girth buckle making it easier to tighten the girth strap of a saddle.

SUMMARY OF THE INVENTION

The invention addresses the problem of the difficulty of fastening and tightening the girth of an English saddle. On a typical English saddle there are three billet straps that have holes in them for attachment to the girth buckles. On the other side of the saddle are two girth straps that hang down from the saddle and are looped underneath the horse for attachment to the billet straps, thereby fastening the saddle to the horse. If a horse inflates its girth in the process of being saddled, then it is difficult to pull the buckles far enough so that they can reach the billet straps and be buckled to the billet straps. The present invention is a hook attached to a flexible strap. The hook is inserted into an upper hole of a billet strap. The bottom part of the flexible strap is looped through a girth buckle so that a person can exert an upward force on the flexible strap and apply a leveraged force to a girth buckle making it easier to move the buckle to the billet strap and subsequently buckle the girth buckles to the billet straps. The device of the present invention is described as used on an English saddle. However, if a Western saddle was equipped with the girth strap and billet strap that are commonly used with English saddles then the present invention would be equally useful on a Western saddle.

Therefore, it is an object of the present invention to provide a hook and flexible strap that will assist children and adults that do not have sufficient strength or nimbleness of fingers to quickly and easily tighten the girth of their saddle. It is a further object of the present invention to provide a flexible strap and hook for people that have to quickly saddle several horses at a time for horse shows and riding schools thereby saving them time and strained muscles. This device also allows horse owners to tighten and fasten the girth of a saddle on a horse that inflates his girth when being saddled.

DETAILED DESCRIPTION OF THE INVENTION

This is a tool for assisting a person to quickly and easily fasten and tighten the girth strap of a saddle on a horse.

Figure 1:
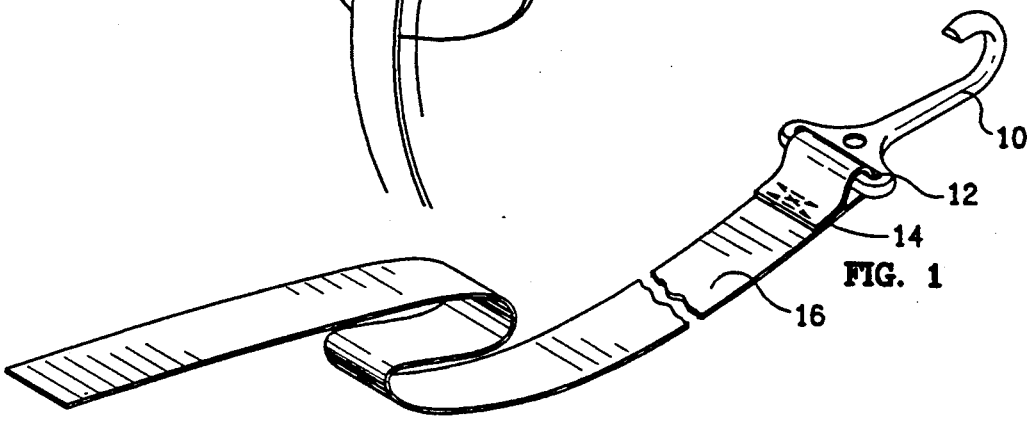
FIG. 1 is a perspective view of the invention which is a metal hook with a rectangular opening wherein the strap is looped through the rectangular opening.

Referring to FIG. 1, the device comprises a metal hook 10 with a rectangular opening at its base 12 and a flexible strap 16 looped through the base 12 and fastened at an area 14 in a standard manner such as sewing or rivets.

Figure 2:
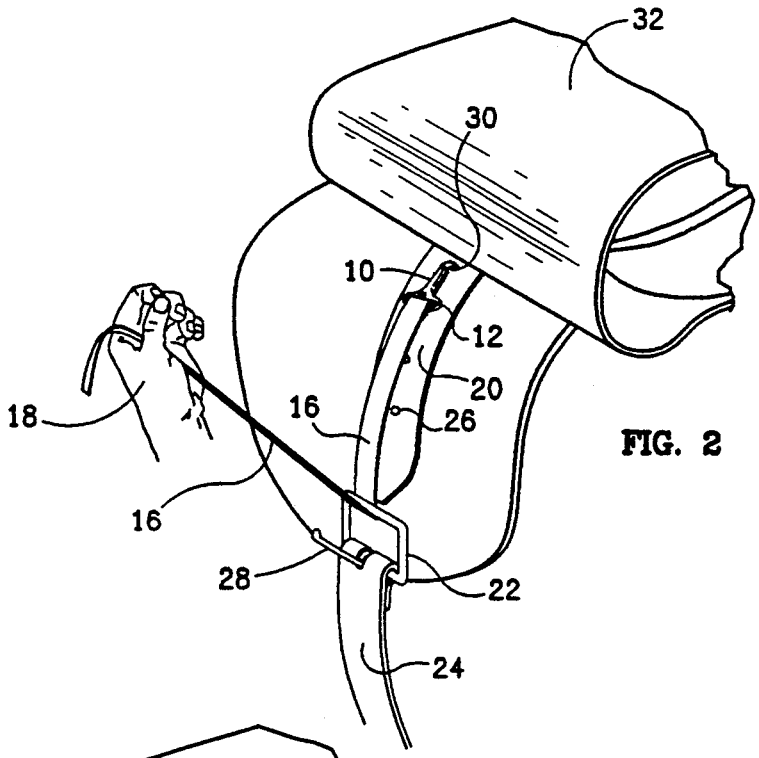
FIG. 2 is a side perspective view of an English saddle showing the hook and flexible strap looped through the buckle of a girth strap.

Referring to FIG. 2, the hook 10 is inserted into the top hole 30 of the billet strap 20 of the saddle 32. The flexible strap 16 is then inserted through the buckle 22 of the girth strap 24 and is drawn upward so that the billet strap 20 can be inserted through the buckle 22 by pulling up on the strap 16 with the rider's hand 18.

Figure 3:
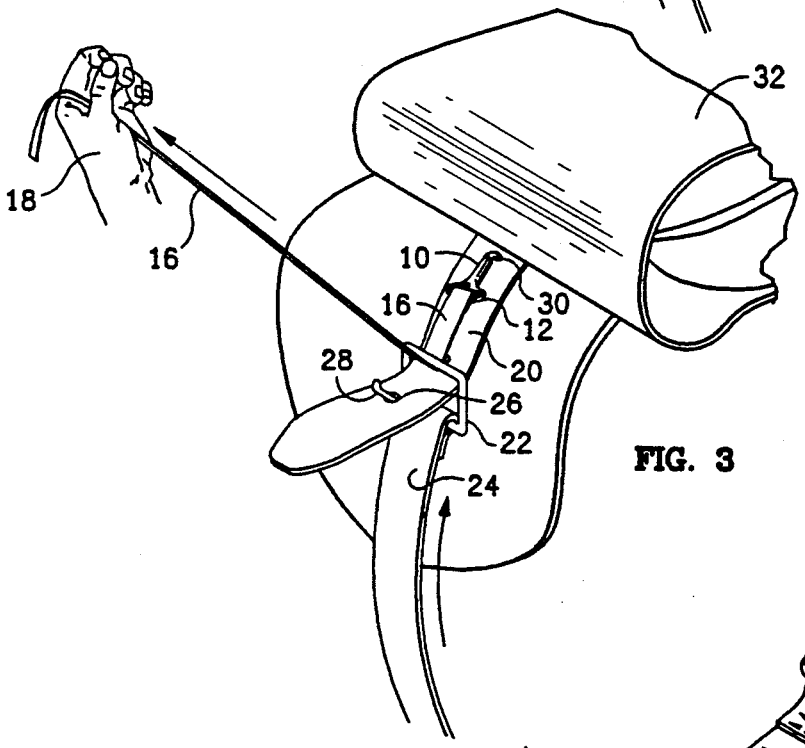
FIG. 3 is a side perspective view of a girth buckle which has come in contact with the billet strap as aided by the hook and flexible strap used to apply leverage to the girth buckle.

As shown in FIG. 3, the strap 16 has brought the buckle 22 up to the hole 26 where the girth strap 24 can be secured to the desired tightness. This allows the tongue 28 of the buckle 22 to slip easily into the hole 26 of the billet strap 20.

Before fastening the tongue 28 of the buckle 22, the strap 16 is slid to either side of the tongue 28 in order to facilitate the removal of the strap 16. To remove the strap 16 pull upward from the area 14 of the strap 16. The hook 10 is removed by sliding it out with an upward and outward motion.

The present invention has been described as a hook used in conjunction with a flexible strap. However, the hook could be eliminated and the flexible strap 16 could be permanently affixed to the upper portion of the billet strap 20 by sewing or riveting the upper portion of strap 16 to the upper portion of billet strap 20. Other standard means of attaching a flexible strap to a suitable portion of an English saddle could also be used.

Although particular embodiments of the present invention as illustrated in the drawings have been described, it will be understood, of course, that the present invention is not limited thereto, since modification and variations may readily occur to those skilled in the art, and consequently, it is intended that the claims be interpreted to cover such modifications and equivalence.

WHAT IS CLAIMED

1. A device for assisting a person who is saddling a horse where the horse has expanded its girth by allowing said person to apply leverage to a girth buckle when attaching said girth buckle to a billet strap comprising:

hook means for engaging the billet strap with a curved hook end for insertion into the holes of a billet strap, said hook means including an attachment means for allowing attachment to a flexible strap, and strap means attached to said hook means at said attachment means, where said hook means is engaged in the billet strap, the strap means is inserted through the girth buckle, and leverage force is applied to the girth buckle to draw the billet strap into the girth buckle to aid in attachment of said girth buckle to said billet strap.

2. A saddlery device comprising:

hook means having a curved hook at one end and an attachment means at a second end, and strap means attached to said hook means at said attachment means, where said hook means is engaged in a billet strap, said strap means is inserted through a girth buckle for applying a leverage force to said girth buckle to draw said billet strap into buckling engagement with said girth buckle.

3. A saddlery device in claim 2 wherein said hook means is made of metal and said strap means is made from nylon.

4. A saddlery device comprising:

strap means having a first end and a second end wherein said first end is attached to the upper portion of a billet strap, said second end of said strap means is inserted through a girth buckle, where leverage force is applied to said girth buckle to said billet strap toward said girth buckle to aid in attachment of said girth buckle to said billet strap.

* * * * *

UNITED STATES PATENT AND TRADEMARK OFFICE

CERTIFICATE OF CORRECTION

PATENT NO. : 5.226.282

DATED : July 13, 1993

INVENTOR(S) : Vilma Meyers

It is certified that error appears in the above-indentified patent and that said Letters Patent is hereby corrected as shown below:

| | |
|---|---|
| Column 2, lines 45-46 | change "saddling a horse where" to -- saddling a horse, where --. |
| Column 2, Line 46 | change "its girth" to -- its girth, --. |
| Column 4, Line 4, | change "buckle to said" to -- buckle to draw said --. |

Signed and Sealed this

Eighteenth Day of April, 1995

Bruce Lehman

BRUCE LEHMAN

*Commissioner of Patents and Trademarks*

*Attest:*

*Attesting Officer*